US007220524B2

(12) United States Patent
Heilman et al.

(10) Patent No.: US 7,220,524 B2
(45) **Date of Patent: *May 22, 2007**

(54) SYSTEM AND METHOD FOR PRODUCING SECURE TONER-BASED IMAGES

(75) Inventors: Kevin L. Heilman, Wheeling, WV (US); Michael R. Riley, Steubenville, OH (US)

(73) Assignee: Troy Group, Inc., Santa Ana, CA (US)

( * ) Notice: Subject to any disclaimer, the term of this patent is extended or adjusted under 35 U.S.C. 154(b) by 216 days.

This patent is subject to a terminal disclaimer.

(21) Appl. No.: 10/972,930

(22) Filed: Oct. 25, 2004

(65) Prior Publication Data

US 2005/0058921 A1 Mar. 17, 2005

Related U.S. Application Data

(63) Continuation-in-part of application No. 10/437,751, filed on May 14, 2003, now Pat. No. 6,998,211.

(51) Int. Cl.
*G03G 9/00* (2006.01)

(52) U.S. Cl. ..... 430/108.21; 430/108.1; 430/108.11; 430/108.23; 430/124; 430/137.1; 430/137.18; 430/10

(58) Field of Classification Search ..... 430/108.21, 430/108.1, 108.11, 108.23, 124, 137.1, 137.18, 430/10

See application file for complete search history.

(56) References Cited

U.S. PATENT DOCUMENTS

| | | | | |
|---|---|---|---|---|
| 4,496,961 | A | 1/1985 | Devrient | 346/206 |
| 4,936,607 | A | 6/1990 | Brunea et al. | 283/70 |
| 4,942,410 | A | 7/1990 | Fitch et al. | 346/160.1 |
| 4,958,173 | A | 9/1990 | Fitch et al. | 346/160.1 |
| 5,033,773 | A | 7/1991 | Brunea et al. | 283/95 |
| 5,123,999 | A | 6/1992 | Honnorat et al. | 162/140 |
| 5,124,217 | A | 6/1992 | Gruber et al. | 430/39 |
| 5,366,833 | A | 11/1994 | Shaw et al. | 430/10 |
| 5,523,167 | A | 6/1996 | Hunt et al. | 428/484 |
| 5,666,598 | A | 9/1997 | Sugita et al. | 399/136 |
| 5,698,616 | A | 12/1997 | Baker et al. | 523/201 |
| 5,714,291 | A | 2/1998 | Marinello et al. | 430/106 |
| 6,991,883 | B2 * | 1/2006 | Riley et al. | 430/108.21 |
| 6,998,211 | B2 * | 2/2006 | Riley et al. | 430/108.21 |

* cited by examiner

*Primary Examiner*—Mark A. Chapman

(57) ABSTRACT

A system and a method for printing a secure document that is difficult to forge and readily easy to visually verify are disclosed. The system includes a colorant for printing an image on a surface of a document, a dye for forming a latent version of the image underneath the surface, a substrate, and a migration agent for facilitating the migration of the dye through at least a portion of the substrate. The migration agent may be coated onto a portion of the substrate or embedded within the substrate. An ink may serve as the migration agent, in which case, the ink contains a solute for the dye.

25 Claims, 4 Drawing Sheets

SYSTEM AND METHOD FOR PRODUCING SECURE TONER-BASED IMAGES

CROSS REFERENCE TO RELATED APPLICATIONS

This application is a continuation-in-part of U.S. patent application Ser. No. 10/437,751, entitled SYSTEM FOR PRODUCING TONER-BASED IMAGES AND METHODS OF FORMING AND USING THE SAME, filed May 14, 2003. now U.S. Pat. No. 6,998,211

FIELD OF INVENTION

The present invention relates to systems and methods for printing and copying documents. More particularly, the invention relates to toner-based imaging systems for printing or copying documents in a secure manner, such that the documents are difficult to forge and original versions of the documents are readily verifiable, and to methods of using and making the system. The documents include a substrate such as paper or a polymer-based film, and may additionally include a printing ink, on the substrate, which interacts with a dye in a toner to form a more secure document.

BACKGROUND OF THE INVENTION

Toner-based document imaging, such as electrophotographic, iongraphic, magnetographic, and similar imaging techniques, generally involves forming an electrostatic or magnetic image on a charged or magnetized photoconductive plate or drum, brushing the plate or drum with charged or magnetized toner, transferring the image onto a substrate such as paper, and fusing the toner onto the substrate using heat, pressure, and/or a solvent. Using this technique, relatively inexpensive images can be easily formed on a surface of the substrate.

Because toner-based imaging is a relatively quick and inexpensive technique for producing copies of images, the technique is often employed to produce documents that were traditionally formed using other forms of printing or imaging—e.g., impact printing or ink-jet printing. For example, in recent years, toner-based imaging has been employed to produce financial documents, such as personal checks, stocks, and bank notes; legal documents such as wills and deeds; medical documents such as drug prescriptions and doctors' orders; and the like. Unfortunately, because the image is formed on the surface of the substrate, documents produced using toner-based imaging techniques are relatively easy to forge and/or duplicate.

Various techniques for printing or forming secure documents have been developed over the years. Early secure printing techniques generally included improvements to paper onto which material was printed or written. For example, U.S. Pat. No. 1,727,912, issued to Snyder on Sep. 10, 1929 discloses a paper for producing a secure document that includes a coating with relatively low ink absorption properties and a paper body portion that readily absorbs the ink. A secure document is formed by slitting or rupturing the coating during a writing process, such that the ink penetrates the absorbent portion of the paper. U.S. Pat. No. 4,496,961, issued to Devrient on Jan. 29, 1985, discloses another paper-related secure printing technique. Devrient discloses a check paper that includes crushable micro capsules that contain leuco ink and a color acceptor. When an image is written onto a surface of the paper, the micro capsules are crushed and the leuco ink reacts with the color acceptor to produce an image within the body of the check paper, making the image difficult to forge. U.S. Pat. No. 4,936,607, issued to Brunea et al. on Jul. 26, 1990 and U.S. Pat. No. 5,033,773, issued to Brunea et al. on Jul. 21, 1991 both disclose another secure document printing technique that includes microcapsules containing a solvent and a colorant. Upon impact, the microcapsules burst to create a colored halo effect surrounding an image printed onto the surface of the document, making the image printed on the surface of the document more difficult to forge. Although these techniques work relatively well for impact-type printing or copying, the techniques would not work well in connection with toner-based printing methods.

Other techniques for producing secure images include providing special paper coatings to increase smudge resistance of an image created by an electrostatic process. U.S. Pat. No. 4,942,410, issued to Fitch et al. on Jul. 17, 1990 and U.S. Pat. No. 4,958,173, issued to Fitch et al. on Sep. 18, 1990 both disclose a toner-receptive substrate coating that includes polymer binders and mineral fillers above one micron in size. The coating purportedly exhibits high durability smudge resistance compared to otherwise conventional substrates and thus makes forgery by way of removing a portion of the printed image more difficult. However, the coating described in the Fitch et al. patents does not appear to affect an ability to add material to the document or authenticate the originality of the document.

U.S. Pat. No. 5,123,999, issued to Honnorat et al. on Jun. 23, 1992, discloses another type of forgery-resistant paper. The paper of Honnorat et al. includes an aromatic compound and a binder and/or activator. The aromatic compound and binder or activator react with reducing agents typically found in ink eraser felt to produce a coloring effect, indicating attempted erasure of a portion of an image printed on the paper. This technique does not affect an ability to form a copy of the document or to verify an original copy.

U.S. Pat. No. 5,523,167 discloses a technique for producing secure Magnetic Character Recognition (MICR) symbols using a film including an inert backing coated with a mixture of a resin, a filler, a magnetic pigment, a nondrying oil, and an oil soluble dye. Upon impact, a portion of a transfer layer transfers to a document surface to form a magnetically-readable character image. After the transfer, the non-drying oil contained in the transferred coating begins to diffuse into a substrate. The oil carries the visible oil-soluble dye through the substrate, such that the MICR image appears on the opposite side of the substrate.

U.S. Pat. No. 5,124,217, issued to Gruber et al. on Jun. 23, 1992, discloses a secure printing toner for electrophotographic processing. This toner, when exposed to a solvent such as toluene, often used in document forgery, produces a color stain indicative of the attempted forgery. This toner is only useful to disclose an attempted forgery when a particular solvent is used to remove a portion of a printed image. Thus, the toner cannot be used to mitigate copying of the document or forgery by adding material to the document.

Finally, U.S. Pat. No. 5,714,291, issued to Marinello et al. on Feb. 3, 1998, discloses a toner that includes submicron ultraviolet sensitive particles. An authenticity of the document can be verified using an ultra-violet scanner. Requiring use of an ultra-violet scanner is generally undesirable because it adds cost to a forgery analysis and requires additional equipment.

For the foregoing reasons, improved methods and apparatus for forming secure documents using toner-based processing, which are relatively easy and inexpensive, are desired.

SUMMARY OF THE INVENTION

The present invention provides an improved system for producing secure images using a toner-based imaging process and improved methods of forming and using the system. Besides addressing the various drawbacks of the now-known systems and methods, in general, the invention provides a toner-based printing system that produces images that are difficult to alter and that are easy to visually asses whether the image has been altered.

In accordance with one embodiment of the invention, the secure document printing system includes a substrate and a toner. The toner includes a colorant that forms a printed image on a first surface of a substrate and a dye that migrates through the substrate to form a latent version of the image that is visible on a second surface of the substrate. In accordance with one aspect of this embodiment, the toner includes a thermoplastic resin binder, a charge-controlling agent, a release agent, as well as the colorant and the dye. In accordance with a further aspect of this embodiment, the substrate includes a migration-enhancing agent formed on or within a substrate such as paper or polymer based film. Exemplary migration-enhancing agents include oils, plasticizers, and other polymeric materials. In general, the migration-enhancing agent facilitates migration of the dye from the first surface of the substrate to the second surface of the substrate and acts as solvent for the dye. In accordance with further aspects of this embodiment, the substrate includes an ink, which facilitates migration of a dye through a portion of the substrate. Exemplary suitable inks include solvent based inks, water based inks, vegetable oil inks, soy oil inks, and radiation cured inks. Such inks generally contain oils, plasticizers, and other polymeric materials. The combination of the toner and the substrate can be used to produce a secure image that is difficult to forge and that is easy to determine whether the image is an original copy of the document by comparing the printed image formed on the first surface of the substrate with the dye-formed copy of the image visible from the second surface of the substrate.

In accordance with another embodiment of the invention, a secure toner-based printing system includes a substrate and a toner that includes a colorant that forms a printed image on a first surface of a substrate and a dye that migrates through a portion of the substrate and forms a copy of the image that is visible from the first surface of the substrate. The printed image can be compared to the copy formed with the dye to determine if the original printed image has been altered.

In accordance with a further embodiment of the invention, the toner and/or the substrate includes a colorless, dye-forming agent and a co-reactant that reacts with the dye-forming agent to produce a latent image of a printed image.

In accordance with another embodiment of the invention, a substrate including a migration-enhancing agent is formed by admixing the migration-enhancing agent to a paper-pulp mixture. In accordance with one aspect of this embodiment, the migration-enhancing agent includes an oil, a plasticizer, a liquid polymer, or any combination thereof.

In accordance with a further embodiment of the invention, a substrate including a migration-enhancing agent is formed by coating a base with a migration-enhancing agent substance. In accordance with one aspect of this embodiment, the migration-enhancing agent includes an oil, a plasticizer, a liquid polymer, or any combination thereof. In accordance with a further aspect of this embodiment, both a first surface and a second surface of a base are coated with the migration-enhancing agent substance.

In accordance with another embodiment of the invention, a substrate including a colorless, dye-forming agent and/or a co-reactant is formed by coating a portion of the substrate with the dye-forming agent and/or a co-reactant.

In accordance with another embodiment of the invention, a substrate including a colorless, dye-forming agent and/or a co-reactant is formed by adding the dye-forming agent and/or a co-reactant to a pulp-mixture (for a paper substrate) or into the polymer extrusion process (for a polymer-based substrate). In accordance with one aspect of this embodiment of the invention, one or both of the dye-forming agent and/or a co-reactant are encapsulated and comprise about 1–5 weight percent of the substrate material.

In accordance with yet another embodiment of the invention, a method of forming a toner includes melt-blending binder resin particles, mixing colorant particles, charge-control agents, release agents, the dye, and migration agents with the resin particles, cooling the mixture, classifying the mixture, and dry blending the classified mixture with inorganic materials. In accordance with alternative embodiments of the invention, the toner is formed using melt dispersion, dispersion polymerization, suspension polymerization, or spray drying.

In accordance with another embodiment of the invention, an image is formed on a substrate by electrostatically transferring an image to a first surface of the substrate and forming a copy of the image that is visible from a second surface of the substrate by applying a toner, including a migrating dye, to the substrate. In accordance with one aspect of this embodiment, the method of forming an image includes providing a substrate that includes a migration-enhancing agent.

BRIEF DESCRIPTION OF THE DRAWING FIGURES

A more complete understanding of the present invention may be derived by referring to the detailed description and claims, considered in connection with the figures, wherein like reference numbers refer to similar elements throughout the figures, and;

FIG. 1 illustrates a system for printing secure documents in accordance with the present invention;

FIG. 2(*a*) and FIG. 2(*b*) illustrate a check formed using the system of the present invention;

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

The following description is provided to enable a person skilled in the art to make and use the invention and sets forth the best modes contemplated by the inventors of carrying out their invention. Various modifications to the description, however, will remain readily apparent to those skilled in the art, since the general principles of forming a toner-based system for forming secure images on a document and methods of forming and using the system have been defined herein.

Figure 1:
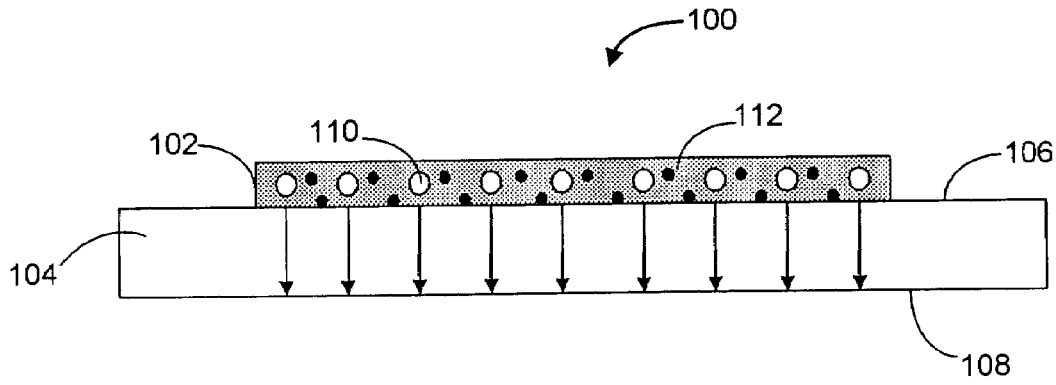

FIG. 1 illustrates a system 100 for printing secure documents in accordance with one embodiment of the present invention. System 100 includes a toner 102 and a substrate 104, which work together to produce a printed image on a first surface 106 of substrate 104 and a latent copy of the image, underlying the printed image, which is visible from the first (106) and/or second surface (108) of the substrate. Documents formed using system 100 are difficult to forge and copies of documents are easily detected, because any mismatch between the printed image and the latent image indicates forgery and a missing latent image is indicative of a copy of the document.

An image is printed onto a substrate using system 100 by transferring toner 102 onto substrate 104 using, for example, an electrostatic or electrophotographic process. In this case, the toner is transferred to a portion of the substrate to create a desired image and the image is fused to the substrate using, for example, heat and/or vapor solvent processing. A latent image of the printed image is formed as a result capillary or chromatographic migration of the dye to an area underlying the printed surface of the document.

Figure 2A:
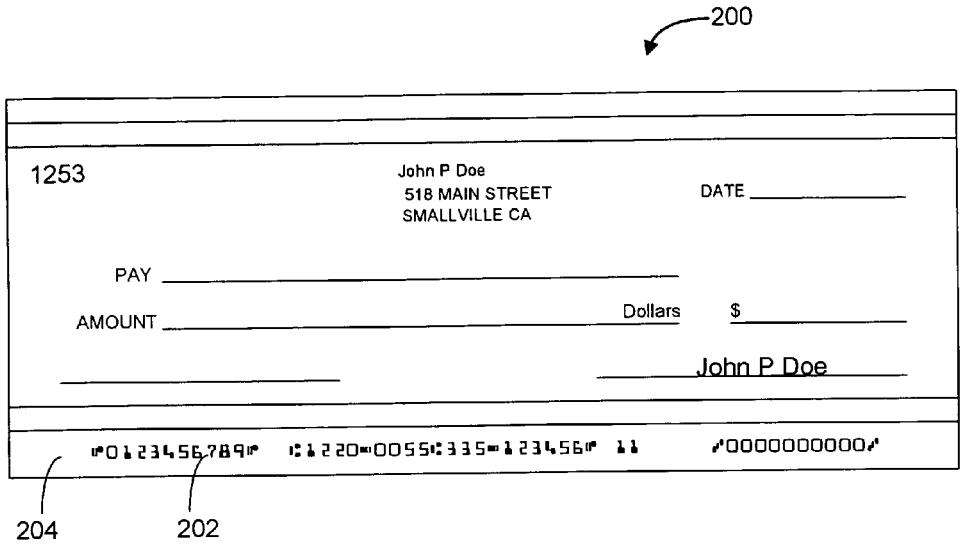
Figure 2B:
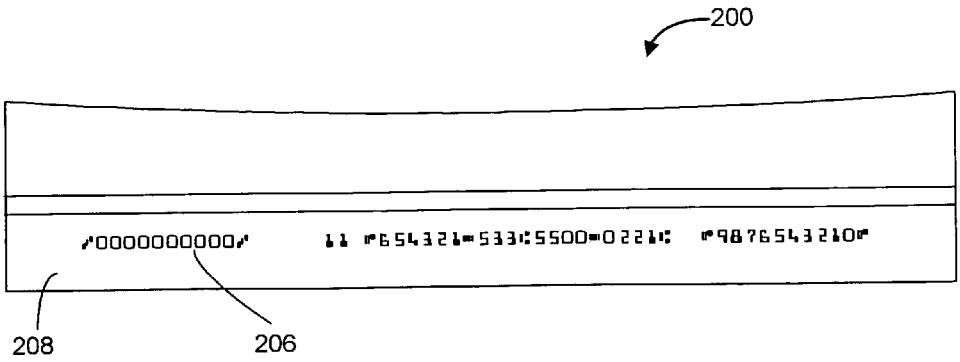

FIGS. 2(*a*) and 2(*b*) illustrate a check 200 formed using system 100. In particular, FIG. 2(*a*) illustrates an image 202 printed on a first surface 204 of the check and an image 206, which forms as a result of the migrating dye, formed on or visible from an opposite surface 208 of the check.

Referring again to FIG. 1, in accordance with one embodiment of the invention, toner 102 includes a thermoplastic binder resin, a colorant, a charge-controlling agent, and a migrating dye 110. Each of the thermoplastic binder resin, the colorant, and the charge-controlling agent may be the same as those used in typical toners. Toner 102 may also include additional ingredients such as a migrating agent 112. Migrating agent 112 may be configured to assist dye 110 to migrate through the substrate and/or help fuse the dye in place after an initial migration of the dye to—e.g., mitigate lateral spread of the dye. For illustration purposes, only the dye and the migrating agent are separately illustrated in FIG. 1. Although the illustrated toner is a one-component toner, multiple-component toner compositions (e.g., toner and developer) may also be used to form secure documents as described herein. Toners suitable for use with this invention are described in application Ser. No. 10/437,816, entitled TONER FOR PRODUCING SECURE IMAGES AND METHODS OF FORMING AND USING SAME, for which an application for United States Letters Patent was filed on May 14, 2003, by the assignee hereof, the contents of which are hereby incorporated herein by reference.

The thermoplastic binder resin helps fuse the toner to the substrate. In accordance with one embodiment of the invention, the binder resin has a melt index of between about 1 g/10 min. and 50 g/10 min. at 125° C. and has a glass transition temperature between about 50° C. and about 65° C. Exemplary materials suitable for the thermoplastic binder resin include polyester resins, styrene copolymers and/or homopolymers—e.g., styrene acrylates, methacrylates, styrene-butadiene—epoxy resins, latex-based resins, and the like. By way of particular example, the thermoplastic binder resin is a styrene butadiene copolymer sold by Eliokem as Pliolite S5A resin.

The colorant for use with toner 102 can be any colorant used for electrophotographic image processing, such as iron oxide, other magnetite materials, carbon black, manganese dioxide, copper oxide, and aniline black. In accordance with one particular example, the colorant is iron oxide sold by Rockwood Pigments as Mapico Black.

The charge-control agent helps maintain a desired charge within the toner to facilitate transfer of the image from, for example, an electrostatic drum, to the substrate. In accordance with one embodiment of the invention, the charge control agent includes negatively-charged control compounds that are metal-loaded or metal-free complex salts, such as copper phthalocyanine pigments, aluminum complex salts, quaternary fluoro-ammonium salts, chromium complex salt type axo dyes, chromic complex salt, and calix arene compounds.

As noted above, the toner may also include a releasing agent such as a wax. The releasing agent may include low molecular weight polyolefins or derivatives thereof, such as polypropylene wax or polyethylene wax.

Preferred dyes in accordance with the present invention exhibit a strong color absorbance through substrate 104, good solubility in a migration fluid, and good stability. Furthermore, ambient heat, light, and moisture conditions, preferably do not detrimentally affect the development properties of the toner, which is non-toxic. In addition, the dyes are preferably indelible. Exemplary soluble dyes for toner 102 include phenazine, stilbene, nitroso, triarylmethane, diarlymethane, cyanine, perylene, tartrazine, xanthene, azo, diazo, triphenylmethane, fluorane, anthraquinone, pyrazolone quinoline, and phthalocyanine. In accordance with one embodiment of the invention, the dye is red in color and is formed of xanthene, sold by BASF under the trade name Baso Red 546, although other color dyes are also suitable for use with this invention.

In accordance with additional embodiments of the invention, the latent image is formed using a color-forming dye such as triphenylmethane or fluorane, and a corresponding co-reactant is contained in either the toner or the substrate. The co-reactant, such as an acidic or electron-accepting compound, reacts with the color-forming dye to produce a latent image of the printed image. Exemplary co-reactant materials include bisphenol A or p-hydroxybenzoic acid butyl ester, which can also function as charge-controlling agents. The color-forming dyes are typically positively charged and thus are used in positively-charged toners. In accordance with alternative embodiments of the invention, described in more detail below, either the color-forming dye and/or the co-reactant may be on or within the substrate and configured to react with each other, e.g., during a fusing process, to form the security image.

When the toner includes a migration-enhancing agent, the agent may be directly incorporated with the other toner components, or mixed with the dye and then mixed with the other toner components, or adsorbed onto silica or similar compounds and then added to the other toner components, or encapsulated in a material that melts during the fusing process, or encapsulated with the dye.

An exemplary toner is formed by initially melt-blending the binder resin particles. The colorant, charge controlling agent(s), release agent(s), dye(s), and the optional migration agent(s) are admixed to the binder resin particles by mechanical attrition The mixture is then cooled and then micronized by air attrition. The micronized particles that are between about 0.1 and 15 microns in size are classified to remove fine particles, leaving a finished mixture having particles of a size ranging from about 6 to about 15 microns. The classified toner is then dry blended with finely divided particles of inorganic materials such as silica and titania. The inorganic materials are added to the surface of the toner for the primary purpose of improving the flow of the toner particles, improving blade cleaning of the photoresponsive imaging surface, increasing the toner blocking temperature, and assisting in the charging of the toner particles. Alternatively, the security toner can be made by other types of mixing techniques not described herein in detail. Such alternative methods include melt dispersion, dispersion polymerization, suspension polymerization, and spray drying.

The following non-limiting examples illustrate various combinations of materials and processes useful in forming a toner in accordance with various embodiments of the invention. These examples are merely illustrative, and it is not intended that the invention be limited to these illustrative examples.

Toner Example I

The following example illustrates a preparation of an 8-micron security toner for the use in electrophotographic printing. A toner composition containing the specific composition tabulated below is initially thoroughly pre-mixed and then melt mixed in a roll mill. The resulting polymer mix is cooled and then pulverized by a Bantam pre-grinder (by Hosokawa Micron Powder System). The larger ground particles are converted to toner by air attrition and classified to a particle size with a median volume (measured on a Coulter Multisizer) of approximately 8 microns. The surface of the toner is then treated with about 0.5% dimethyldichlorosilane treated silica (commercially available through Nippon Aerosil Co. as Aerosil R976) by dry mixing in a Henschel mixer.

| Component | Chemical | Manufacturer | Exemplary Compositions (weight parts) | Specific Composition (weight parts) |
|---|---|---|---|---|
| Thermoplastic Binder Resin | Linear Polyester | Image Polymers-XPE-1965 | 20–50 | 46 |
| Charge-Controlling Agent | Aniline | Orient Chemical Company-Bontron NO1 | 0–3 | 1 |
| Colorant | Iron Oxide | Mapico Black | 10–50 | 42 |
| Releasing Agent | Polypropylene | Sanyo Chemical Industries-Viscol 330P | 0–15 | 5 |
| Dye | Azo organic Dye | Keystone Aniline Corp. Keyplast Red | 1–20 | 6 |

This prepared mono-component toner is loaded into the proper cartridge for the intended printer such as the Hewlett Packard 5Si printer. An image formed using this toner exhibits a density measuring greater than 1.40 with a MacBeth Densitometer, sharp characters, and initially no migration of the red visible dye is noticed with standard Hammermill 20 pound laser copy paper.

Toner Example II

The following example illustrates a preparation of a 10-micron security Magnetic Ink Character Recognition (MICR) toner, including the specific weight composition tabulated below, for use in electrophotographic printing. A toner composition containing the specific composition is initially thoroughly mixed and then melt mixed in a roll mill. The resulting polymer mix is cooled and then pulverized by a Bantam pre-grinder. The larger ground particles are converted to toner by air attrition and classified to a particle size with a median volume (measured on a Coulter Multisizer) of approximately 10-microns. The surface of the toner is then treated with about 1.0% Hexamethyldisilazane treated silica (commercially available through Nippon Aerosil Co. as Aerosil R8200) by dry mixing in a Henschel mixer.

| Component | Chemical | Manufacturer | Exemplary Composition (weight parts) | Specific Composition (weight parts) |
|---|---|---|---|---|
| Thermoplastic Binder Resin | Linear Polyester | Image Polymers XPE-1965 | 20–50 | 46 |
| Charge-Controlling Agent | Aniline | Orient Chemical Company Bontron NO1 | 0–3 | 1 |
| Colorant | Iron Oxide | ISK Magnetics - MO4232 | 1–30 | 10 |
| Colorant | Iron Oxide | Rockwood Pigments Mapico Black | 10–50 | 32 |
| Releasing Agent | Polypropylene | Sanyo Chemical Industries-Viscol 330P | 0–15 | 5 |
| Dye | Azo organic Dye | Keystone Aniline Corp. Keyplast Red | 1–20 | 6 |

This prepared mono-component toner is loaded into the proper cartridge for the intended printer such as the Hewlett Packard 5Si printer. The resulting image contains a density measuring over 1.40 on the MacBeth Densitometer, high resolution, no noticeable background, and, after initial printing, no migration of the visible red dye with standard Hammermill 20 pound laser copy paper.

For MICR evaluation, the magnetically encoded documents use a E13-B font, which is the standard font as defined by the American National Standards Institute (ANSI) for check encoding. The magnetic signals from a printed document, using the toner described above, were tested using a RDM Golden Qualifier MICR reader. The ANSI standard for MICR documents using the E13-B font requires between 50 and 200 percent nominal magnetic strength. The MICR toner, formed using the formulation provided above, exhibits a MICR signal that has a value of about 100 percent nominal magnetic strength when printing fully encoded documents.

Toner Example III

A toner including a co-reactant for use with a substrate including a dye is formed as follows. A negatively charged charge-control agent including a zinc complex of salicylic acid and about 1% of Magee MSO oil are combined. The zinc complex functions as a suitable co-reactant for Copikem Red dye.

Figure 3:
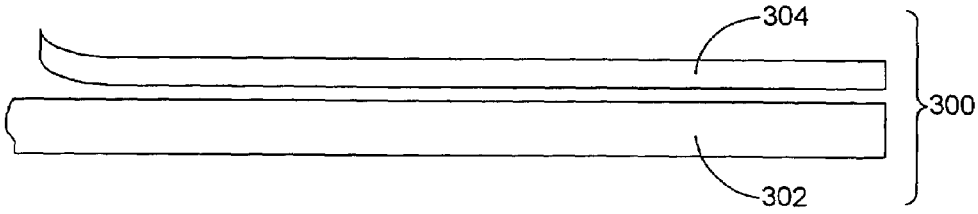
FIG. 3 illustrates a substrate in accordance with one embodiment of the invention.
Figure 4:
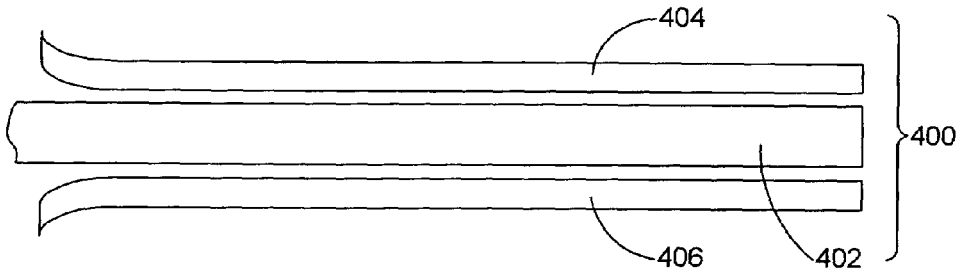
FIG. 4 illustrates a substrate in accordance with another embodiment of the invention.
Figure 5:
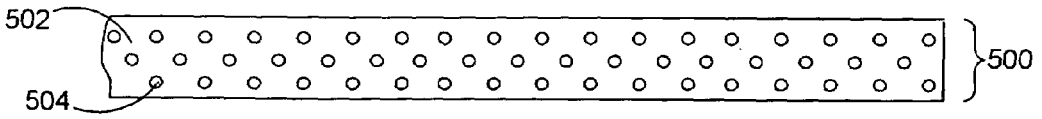
FIG. 5 illustrates yet another substrate in accordance with the present invention.

FIGS. 3–5 illustrate various substrates suitable for printing secure documents in connection with the toner of the invention. More particularly, FIG. 3 illustrates a substrate 300, including a base 302 and a coating 304 that includes a migration agent; FIG. 4 illustrates a substrate 400, including a base 402 and coatings 404 and 406, which include a migration agent; and FIG. 5 illustrates a substrate 500, which includes a migration agent 504 embedded or mixed in a base 502.

Materials suitable for bases 302, 402, and 502 include paper such as pulp-based paper products and polymer-based films. When the substrate is formed of pulp-based paper, the paper pulp fibers may be produced in mechanical, chemical-mechanical, or a chemical manner. Pulp can be manufactured from, for example, a lignocellulosic material, such as softwood or hardwood, or can be a mixture of different pulp fibers, and the pulp may be unbleached, semi-bleached, or fully bleached. In addition to the pulp fibers, a paper base may contain one or more components typically used in paper manufacturing, such as starch compounds, hydrophobizing agents, retention agents, shading pigments, fillers, and triacetin.

Polymer substrates can be formed, using, for example, an extrusion process, from any polymer capable of forming a self-supporting sheet. Suitable polymers include polyethylene, polysulfones, polyvinylchloride, polymethylmethacrylate, polyvinyl acetate, polycarbonates, polypropylene, polyester, cellulose esters. Preferred polymer substrates have a thickness that would range from about 55 μm to about 150 μm.

The migration fluid can be any chemical or compound that acts as a solvent for the dye (e.g., dye 110) and that can be contained within or on the base without significantly detrimentally affecting the characteristics of the base. Exemplary migration agents suitable for coating 304, 404, 406 and for migration agent 504 include oils, plasticizers, liquid polymers, or any combination of these components. In accordance with specific embodiments of the invention, the migration agent includes one or more of: plasticizers such as 2,2, 4 trimethyl-1, 3 pentanediol diisobutyrate, triacetin, bis (2-ethylhexyl adipate), ditridecyl adipate, adipate ester, or phthalate ester; aromatic and aliphatic hydrocarbons such as: carboxylic acids, long chain alcohols, or the esters of carboxylic acids and long chain alcohols; and liquid polymers such as: emulsion of polyvinyl alcohols, polyesters, polyethylenes, polypropylenes, polyacrylamides, and starches.

When the migration fluid is coated onto the substrate, as illustrated in FIGS. 3 and 4, any known coating technique such as rod, gravure, reverse roll, immersion, curtain, slot die, gap, air knife, rotary, spray coating, or the like may be used to form a coating (e.g., coating 304) overlying a base (e.g., base 302). The specific coating technique may be selected as desired and preferably provides a migration-enhancing-agent coating that is substantially uniformly distributed across a substrate such as a traveling web of paper.

A desired amount of the coating containing the migration fluid may vary from application to application. In accordance with one exemplary embodiment of the invention, a substrate includes one coating applied to a surface and the amount of coating is about 0.1 $g/m^2$ to about 20 $g/m^2$, and preferably about 6 $g/m^2$ to about 8 $g/m^2$. In accordance with an alternate embodiment of the invention, illustrated in FIG. 4, where the substrate includes two coatings, it may be desirable to have different migration-enhancing coatings on each surface of the substrate. For example, in accordance with one specific embodiment of the invention, the coating on the back surface is about 0.1 $g/m^2$ to about 20 $g/m^2$, and preferably about 4 $g/m^2$ to about 5 $g/m^2$, and the coating of the front of the substrate is about 0.1 $g/m^2$ to about 5 $g/m^2$, and preferably about 2 $g/m^2$ to about 3 $g/m^2$. A desired amount or thickness of the coating is determined by factors such as the base thickness, porosity of the base, any base pre-treatment, and a desired intensity and clarity of an image formed with the die on the back surface of the substrate. For example, if more dye migration is desired, an amount of coating and/or migration-enhancing agent can be increased, and if less dye migration is desired, an amount of coating and/or migration-enhancing agent can be decreased.

The coating that is applied to paper substrate may contain only the migration-enhancing agent. Alternatively, additional chemicals can be added to the coating to, for example, seal the migration fluid, facilitate separation of multiple substrates from one another, and the like. The additional coating components may be applied with the migration-enhancing agent or in a separate deposition step (before or after application of the migration-enhancing agent to the base). For example, the migration fluid can be sealed within the base paper with a wax material such as Kemamide E wax. Alternatively, the coating may include a polymer such as polyvinyl alcohol or polyethylene glycol, to provide a barrier from one sheet of paper to the next. The migration fluid, whether coated onto the substrate or embedded within the base, can also be encapsulated within a suitable polymer shell that ruptures during the printer fusing process. Alternatively, the migration-enhancing agent may be absorbed onto a carrier such as silica and coated onto the paper. In accordance with one particular example of the invention, which is illustrated in FIG. 4, a first coating 404, which is on a back surface of the substrate includes a wax and suitable solvents to assist with the application of the coating material (which may evaporate after the coating is applied to the base) and the second coating includes only the migration-enhancing agent and any solvents.

In addition to or as an alternative to the migration-enhancing agent, the coating or active agent may include a co-reactant, a colorless and/or dye-forming material as described above to form a security image of the printed image.

Figure 6:
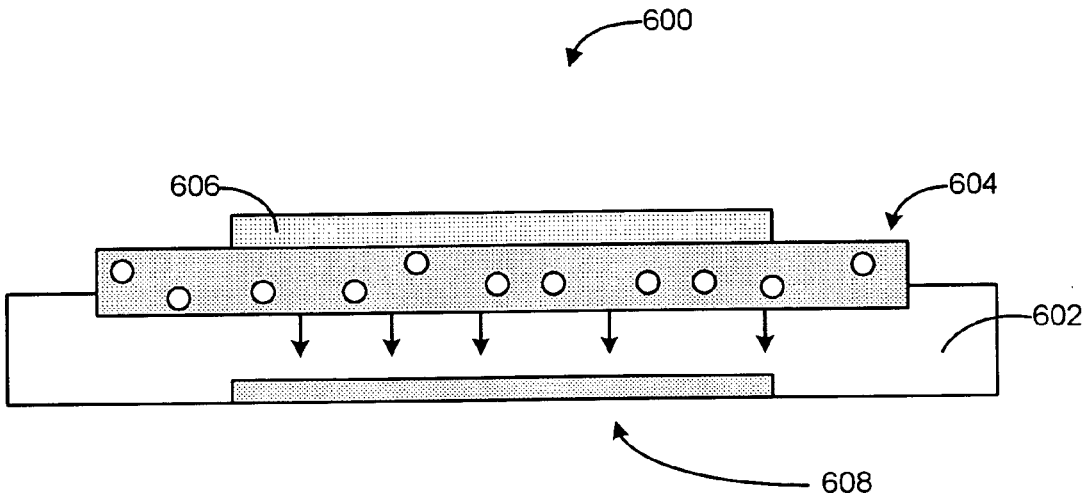
FIG. 6 illustrates another system for printing secure documents in accordance with the present invention.

FIG. 6 illustrates a system 600 in accordance with another embodiment of the invention. System 600 includes a substrate 602, an ink 604 on at least one surface of the substrate, an image printed onto the a surface of the substrate, and an image 608 on a surface of the substrate. Images using system 600 are formed in a manner similar to images formed using system 100, except system 600 includes an additional ink, which facilitates migration of the dye to form image 608. Exemplary printing inks include colorants, such as pigments and soluble dyes, and oils, plasticizers, and/or liquid polymers to facilitate migration of the dye-e.g., petroleum oil.

Ink 606 may be printed onto a surface of base 604 using any known printing technique, e.g., offset printing, flexographic printing, gravure printing, or lithographic printing, and the ink can be printed on top of the substrate, on the back of the substrate, or both. By way of particular example, the ink may be laid down on the substrate, such as International Paper 24 pound MOCR paper, from about 1 to about 300 line screen, and preferably from about 100 to about 150 line screen. The surface of the substrate that the ink is placed determines the interaction between the security toner and the ink. The interaction between the two chemical constituents is highly dependent on the substrate characteristics. Depending on the physical characteristics of the substrate, the amount of the ink that is printed can be changed for optimization of the bleed through process. If the bleed through is not sufficient, the line screen of ink printed can be increased, causing additional ink to interact with the toner.

The following non-limiting examples illustrate various combinations of materials and processes useful in forming a substrate in accordance with various embodiments of the invention. These examples are merely illustrative, and it is not intended that the invention be limited to these illustrative examples.

Substrate Example I

The following paper coating, including the specific weight parts of the components tabulated below is dispersed in a reaction vessel with a high-speed mixer at about 80° C. for about 2 hours. The reaction vessel is allowed to cool to room temperature. The resulting reaction mixture is then filtered using a 50-micron filter. The coating mixture is transferred to a traveling paper web by the gravure roll coating technique. The coating is applied to a substrate in an amount of about 10 g/m$^2$ coat weight.

The coated sheets of paper were tested in combination with the security toner on a Hewlett Packard 5SI laser printer. Initially, the resulting image contained acceptable density, acceptable resolution, no noticeable background, and no migration of the visible red dye. Within about 24 hours of printing, a visible indelible image formed on the non-printed side of the paper. The toner on the printed side of the document was later removed and a red indelible image remained.

Substrate Example II

A paper substrate having a weight of about 75 g/m$^2$, including a migration-enhancing agent embedded within the substrate, is manufactured using a paper mill. The pulp furnish includes about 60% birch sulphate pulp fibers having a brightness of about 89% ISO and about 40% pine sulphate fibers having a brightness of about 90% ISO. Starch, a hydrophobizing agent, a retention agent, a shading pigment, chalk, and triacetin are added as paper to the pulp mixture. The finished paper is initially formed into rolls of paper and then sheeted to a standard size of 8½ inches×11 inches.

A document was printed using the sheets of paper in combination with the security toner described above using a Hewlett Packard 5SI laser printer. Initially, the resulting image had high density, high resolution, with no noticeable background, and no migration of the visible red dye was apparent. Within 24 hours of printing, an indelible image became visible on the non-printed side of the paper. The toner on the printed side of the document was removed and a red residual image remained.

Substrate Example III

A coating suspension is prepared by mixing 2 grams of amorphous silica, 10 ml of Magiesol MSO oil, and 10 grams of Kenamid E Wax. This mixture is heated to melt the wax and is coated on a back surface of Hammermill Copy Paper using a straight piece of glass. The paper was printed using a toner including Pylam Red dye, manufactured by Pylam Products Co., and security images of the printed image appeared within 24 hours of printing.

Substrate Example IV

A substrate including a colorless dye for use with a toner including a co-reactant is formed as follows. Copikem Red dye is dissolved in Magee MSO oil and coated onto Hammermill Copy Paper.

| Component | Chemical | Manufacturer | Exemplary Composition (weight parts) | Specific Composition (weight parts) |
|---|---|---|---|---|
| | Polyethylene Glycol | Dow Chemical | 8–30 | 15 |
| | Polyaziridine Resin | Neoresins Inc Neocryl CX100 | 0–5 | 5 |
| | Bis (2-ethylhexyl adipate) | Aldrich Chemicals | 3–25 | 15 |
| Surfactant | | Chemcentral Triton X100 | 0–2 | 1 |
| Solvent | Isopropyl Alcohol | Interstate Chemical | 25–50 | 32 |
| Solvent | Distilled Water | | 25–50 | 32 |

Substrate Example V

A substrate including a colorless dye for use with a toner including a co-reactant is formed by dissolving about 0.2 grams of Copikem Red dye in about 5 ml of Uniplex 125 A plasticizer, manufactured by Unitex Chemical Co. and coating the mixture onto Hammermill Copy paper.

Substrate Example VI

A substrate including both a dye-forming compound and a co-reactant is formed by separately encapsulating Copikem Red dye and salicylic acid and coating both of the encapsulated components onto Hammermill Copy Paper. When the paper is printed using a printer such as an HP4050 printer, a red security image of the printed images appears on the back side of the paper.

Substrate Example VII

A water based offset ink was sourced from Superior Printing Ink Company. A pantone matching system number 290 ink was printed onto a 24 lb International Paper MOCR bond paper. The ink was laid down using offset printing at 130-line screen.

The finished product was an 8½×11 inch cut sheet of printed paper. The printed substrate was then tested in combination with a security toner (e.g., the toner described above in connection with Toner Example II) on a Hewlett Packard 4100 laser printer. Initially the resulting image contained acceptable density, acceptable resolution, no noticeable background, and no migration of the visible red dye. Within about 48 hours of printing, a visible indelible image formed on the non-printed side of the paper. The toner on the printed side of the document was later removed and a red indelible image remained.

Substrate Example VIII

A 25 mil polypropylene substrate is coated with the same coating mixture that is detailed in Substrate Example I. The coating mixture, which contains the migration agent, is transferred to a traveling polymer web by flexographic roll coating technique. The coating is applied to a substrate in an amount of 6 g/m$^2$ coat weight.

The coated sheets of polypropylene were tested in combination with the security toner (e.g., the toner describe above in connection with Toner Example II) on a Hewlett Packard 4100 laser printer. Initially the resulting image contained acceptable density, acceptable resolution, no noticeable background, and no migration of the visible red dye. Within about 72 hours of printing, a visible indelible image formed on the non-printed side of the paper. The toner on the printed side of the document was later removed and a red indelible image remained.

Although the present invention is set forth herein in the context of the appended drawing figures, it should be appreciated that the invention is not limited to the specific form shown. For example, while the invention is conveniently described in connection with pulp-based paper and polymer-based film, the invention is not so limited; the substrates in accordance with the present invention may include other forms of substrates. Various other modifications, variations, and enhancements in the design and arrangement of the method and system set forth herein, may be made without departing from the spirit and scope of the present invention as set forth in the appended claims.

What is claimed is:

1. A system for producing a secure document using toner-based imaging, the system comprising:

a toner comprising a colorant and a dye;

a polymer-based substrate having a first and second surface; and a migration-enhancing agent, the dye and the migration-enhancing agent being configured to facilitate migration of the dye from the first surface to the second surface of the substrate to form an indelible image on the second surface of the substrate.

2. The system of claim 1, wherein the toner comprises a migration-enhancing agent.

3. The system of claim 1, wherein the toner further comprises a thermoplastic binder resin and a charge-controlling agent.

4. The system of claim 3, wherein the thermoplastic resin component comprises a material selected from the group consisting of one or more of the following: polyester resins, styrene homopolymers or copolymers, epoxy resins, and latex-based resins.

5. The system of claim 3, wherein the charge controlling agent comprises a material selected from the group consisting of copper phthalocyanine pigments, aluminum complex salts, quaternary fluoro-ammonium salts, chromium complex salt type axo dyes, chromic complex salt, and calix arene compounds.

6. The system of claim 1, wherein the colorant comprises a material selected from the group consisting of iron oxide, magnetite materials, carbon black, manganese dioxide, copper oxide, and aniline black.

7. The system of claim 1, wherein the dye comprises a material selected from the group consisting of phenazine, stilbene, nitroso, triarylmethane, diarlymethane, cyanine, perylene, tartrazine, xanthene, azo, diazo, triphenylmethane, anthraquinone, pyrazolone quinoline, and phthalocyanine.

8. The system of claim 7, wherein the dye comprises xanthene.

9. The system of claim 1, wherein the dye and the substrate are configured such that the dye can migrate from a first surface of the substrate to a second surface of the substrate to form an indelible image on the second surface.

10. The system of claim 1, where the polymer-based substrate comprises a thermoplastic polymer selected from a group consisting polyethylene, polysulfones, polyvinylchloride, polymethylmethacrylate, polyvinyl acetate, polycarbonates, polypropylene, polyester, and cellulose esters.

11. The system of claim 1, wherein the migration-enhancing agent selected from the group consisting of an oil, a plasticizer, a liquid polymer, or a combination thereof.

12. The system of claim 1, further comprising an ink printed onto a surface of the substrate.

13. The system of claim 12, wherein the ink comprises a material selected from the group consisting of a solvent based ink, water based ink, vegetable oil ink, or radiation cured ink.

14. The system of claim 12, wherein the ink comprises a material selected from the group consisting of an oil, a plasticizer, a liquid polymer, or a combination thereof.

15. The system of claim 12, wherein the ink is coated onto a first surface of the substrate.

16. The system of claim 15, wherein the ink is coated onto a second surface of the substrate.

17. The system of claim 1, wherein the colorant includes a magnetic material suitable for forming a magnetic character recognition image.

18. A system for producing a secure document using toner-based imaging, the system comprising:

a substrate;

a toner comprising a colorant and a dye printed onto the substrate; and an ink printed onto the substrate, the dye being configured to migrate through a portion of the substrate to form an indelible image of a printed document.

19. The system of claim 18, wherein the ink comprises a migration-enhancing agent.

20. The system of claim 18, wherein the substrate comprises a polymer.

21. The system of claim 18, wherein the substrate comprises a migration-enhancing agent.

22. A method of forming a secure document, the method comprising the steps of:

providing a substrate having a first surface and a second surface;

applying an ink to the first surface of the substrate;

applying a toner including a colorant and a dye in the form of an image to the first surface of the substrate; and forming a copy of the image on the second surface of the substrate with the dye.

23. The method of claim 22, wherein the step of forming a copy comprises the step of creating a copy of the image that is visible from the second surface.

24. The method of claim 22, wherein the step of forming a copy comprises the step of creating a copy of the image that is visible from the first surface.

25. The method of claim 22, wherein the step of providing a substrate comprises the step of furnishing a substrate comprising a migration-enhancing substance.

* * * * *